US005410846A

United States Patent [19]

Frambach

[11] Patent Number: 5,410,846

[45] Date of Patent: May 2, 1995

[54] WINDOW STRUCTURE

[76] Inventor: Harry Frambach, 130 Powell Rd., Allendale, N.J. 07401

[21] Appl. No.: 109,627

[22] Filed: Aug. 20, 1993

[51] Int. Cl.[6] ..... E06B 1/04

[52] U.S. Cl. ..... 52/204.5; 49/400; 49/DIG. 1

[58] Field of Search ..... 52/204.5, 204.51, 204.52, 52/204.6, 204.64, 209, 398; 49/400, 401, 402, DIG. 1

[56] References Cited

U.S. PATENT DOCUMENTS

| | | | |
|---|---|---|---|
| 1,907,091 | 5/1933 | Pettit | 49/401 |
| 1,950,401 | 3/1934 | Fixter | 49/401 |
| 2,612,662 | 10/1952 | Pfaff | 52/207 X |
| 4,409,769 | 10/1983 | Redman | 49/DIG. 7 X |
| 4,447,985 | 5/1984 | Weber et al. | 49/DIG. 7 X |
| 4,875,316 | 10/1989 | Johnston | 52/207 |

*Primary Examiner*—Carl D. Friedman
*Assistant Examiner*—Creighton Smith
*Attorney, Agent, or Firm*—W. Patrick Quast

[57] ABSTRACT

A steel window structure for modern day double paned insulating glass simulating the narrow, elegant sight lines of older steel window structures which secured monolithic, non-insulating glass windows is described. The window securing structure is made deeper and narrower than is currently available in steel windows. This structure now accommodates a single pane of glass of up to 1" thick glass, or up to 1" thick double paned insulating glass. Additionally the new structure inherently provides a thermal break between exterior and interior metal components, the convenient use of two color factory applied finishes for the steel members, and superior air and water resistance over current structures, while at the same time providing the narrow sight lines previously seen only in the older, non-insulating glass steel window structures. Moldings connected to the exterior steel structure provides a "putty slope" shadow effect to complete the simulation of the older steel window structure.

11 Claims, 5 Drawing Sheets

WINDOW STRUCTURE

This invention relates to a window structure, and in particular to a steel window structure having an interior frame unit, an exterior frame unit, insulating glass units, and seal means between the frame units. The window structure can be used as a new or replacement window structure in a wall opening.

BACKGROUND

In a previous patent, U.S. Pat. No. 5,038,537, issued Aug. 13, 1991, I describe a window system and structure utilizing aluminum. The purpose of this prior patent was to teach my development of a practical system for the replacement of windows in Art Deco buildings 50 years old and older that are now designated as landmarks by federal, state, and municipal agencies. These original steel windows with their elegant, slim casements represented modernity and high technology to architects working in the Bauhaus, Art Deco, and Streamlined styles. The characteristics of these steel window structures were:

1. A two inch masonry-to-glass perimeter sight line.
2. A three inch glass-to-glass sight line at operable to operable and operable to fixed framing members.
3. A putty slope, mitered corner appearance around each operable and fixed light with exterior face of glass set back one inch from face of exterior window frame.
4. An uninterrupted narrow reveal around casement leaves.
5. Endless elevation layouts combining fixed and operable lights, where operable lights are virtually indistinguishable from fixed lights.

An object of U.S. Pat. No. 5,038,537 was to provide a practical and economical aluminum window structure to accommodate modern day, double paned insulating glass which is typically 1" thick, and to do so in a manner to duplicate the classic, narrow appearance of the original steel windows. While this object was substantially accomplished in this prior invention, the smallest glass-to-glass sight line that could be obtained was 3" due to the strength limitations of aluminum. To provide even narrower masonry-to-glass and glass-to-glass sight lines as low as, for example, 1¾" would be aesthetically more desirable from the point of view of replacement windows in "significant" older buildings, and also, in the opinion of many current day architects, for new buildings. The instant invention addresses this problem by returning to steel as the main structural material for the window frame.

The basic problem with the old style steel window is that they measure about 1¼" to 1¾" from front to back, which does not provide enough space to install modern day 1" thick insulating glass generally agreed to be the most efficient for strength and energy conservation. To overcome this it is current practice with steel window frames to use longer legged frame members for operating ventilators, such as, for example, casements and awnings. This results in windows which are 40 to 50% wider at the glass-to-glass sight lines because insulating glass requires greater edge engagement and edge tolerance than monolithic non-insulating glass.

Additional problems with current steel window frame construction is that today windows are almost universally glazed from the interior and not from exterior scaffolding. This has given rise to a "flat" exterior appearance of the windows in contrast to the prior protruding portion of the depth of the bars which lent interesting shadows and texture to the older buildings facade. Interior glazing also virtually mandates factory painting and not painting in the field. For economy and convenience both the exterior and interior portion of the steel frame receive the same finish. These finishes must be ultra-violet light resistance, and usually have a shiny finish. Of course, these requirements do not apply to the interior frame which is not exposed to the weather and so could be finished in an entirely different coating.

Another problem with current steel frame window construction is that both the internal and external sections are monolithic, hot rolled steel sections with no provision for any thermal break. While steel has only ⅓ the conductivity of aluminum there is still significant conduction from the exterior to the interior framing members. And the relatively rough surfaces of hot rolled steel present an opportunity for significant air leakage around these frames. Additionally the current steel frame structures rule out the use of "Tuck" or "Jiggle" glazing of the windows, which allows the frame to retain its strength for handling, and permits the interior glazing of fixed lights at the same time.

It is to the above and additional problems which will be discussed below that the instant invention is addressed.

It is therefore a primary object of the present invention to provide a steel window structure which aesthetically replicates the steel window of old while responding to current performance demands of government and industry.

It is an additional object of the present invention to provide a steel window structure with an inherent thermal break between the exterior and interior portions of the frame.

It is a further object of the invention to provide a steel window structure with different factory applied coatings to the exterior and interior portions of the frame.

Another object of the invention is to provide a steel window structure which permits internal "Tuck" or "Jiggle" glazing of the windows.

It is an additional object of the invention to provide for having fixed and operable lights within the same perimeter mainframe wherein they all appear with a uniform profile when viewed from the exterior.

SUMMARY

These and other objects are obtained by the instant invention. I find that by using a simplified structure of cold roll steel I can create a steel window structure which duplicates the narrow sight lines of the old steel window frames, provides an inherent thermal break between external and internal frame members, provides for different factory applied paints (colors) for the exterior and interior frame members, provides for interior Tuck glazing of fixed lights, provides a minimum weather entry resistancy 10 pounds per square foot pressure differential for the window structure, and all within the framework of mounting and supporting a 1" thick insulating glass window pane.

The steel window structure of the invention permits one inch thick insulating glass to lie below the edge of both the ventilator and the perimeter frame. This does away with current steel window frame designs in which the frame bar overlaps the vent bar which in turn overlaps the glass, inevitably giving the window frame a wide and flat exterior appearance. However this new structure effectively reduces the frame width to a point where the frame isn't strong enough to handle, deliver, and install. Further, installation of fixed lights from the interior would be precluded. To permit this narrow frame width I devised a Tuck glazing method not previously employed for steel windows, which allows the frame to retain its strength for handling and interior glazing of fixed lights at the same time.

Further to the aesthetic improvement of steel windows exterior deep contour moldings for affixing to the steel frame were developed with matching contour identical to the exterior putty or bead glazed contour of the old steel windows, one for operable vents and another for the fixed lights.

To have the lateral dimensions of the vent match that in old steel windows a steel "L" or "Z" shape has the necessary twist resistance simply because the depth (in and out) dimension required for this twist resistance was automatically available in order to accommodate 1" insulating glass as well as the exterior deep contour moldings.

For resistance to sag or parallelogramming a space was provided in the structure of the invention for a continuous poured in place bead of structural silicone rubber (RTV). The silicone rubber bonds directly to the glass and to the steel window frame yielding unusual strength to the window structure. For example, standard published maximum width for a steel window is approximately 30" whereas in the instant invention a ventilator width of approximately 40" is permissible.

As has been mentioned above the invention provides a minimum static pressure resistance (due to wind velocity) of 10 lbs./sq. ft. The invention provides significantly improved resistance to air and water than steel windows based upon current steel window structures. For example, current steel window structures utilize hot rolled steel sections which have a relatively rough surface (even after finishing) which permits significant air leakage through the frame. The simplified design of the steel members of the instant invention permits the convenient use of cold roll steel with its smoother surfaces providing tighter elastomerc air seals. In addition the steel window of the invention provides for more reliable pressure equalization. Air pressure is duplicated in the cavity between the ventilator and the frame by means of strategically placed weep holes to the exterior, and an unusually reliable interior air seal. This means that any water that gets by the rain screen between the vent and frame exterior portions will merely flow to the exterior and not build up in the cavity, and thence to spill into the interior.

From the foregoing it can be seen that in creating a steel window to replicate the desirable narrow sight lines of the old steel windows while accommodating current demand for insulating glass, a functionally superior window results.

DETAILED DESCRIPTION

Figure 1:
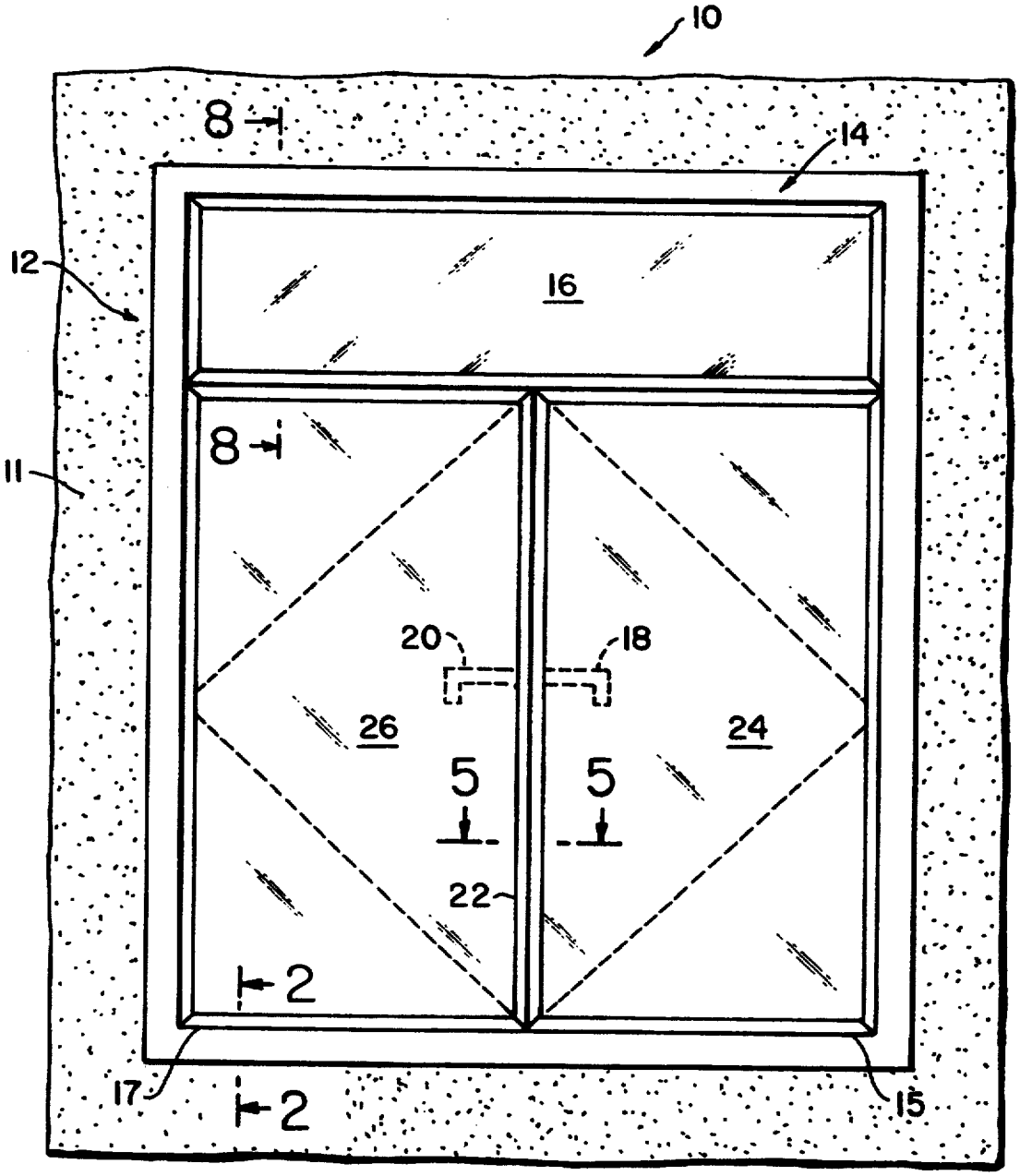
FIG. 1 is an exterior elevation view of one possible window structure of the invention.

Referring now to FIG. 1 a steel window structure 10 is shown in place within an opening in a masonry wall 11. As seen from the exterior a perimeter external frame 12 encloses both a fixed light exterior frame 14 and right hand 15 and left hand 17 operable lights exterior frames. Panes of insulating glass (16, 24, 26) are shown within the fixed and operable light frames. Left 20 and right 18 lock handles for opening and closing operable light exterior frames (17, 15) are depicted in phantom.

It is important to note that this steel window structure, while accommodating modern day 1" thick insulating glass window panes, contains both fixed and operable lights within the same perimeter mainframe, conjoined with intermediate main frame bars (either full T or semi T as will be further discussed below), arranged in a manner so that they all appear with a uniform profile when viewed from the exterior.

Figure 2:
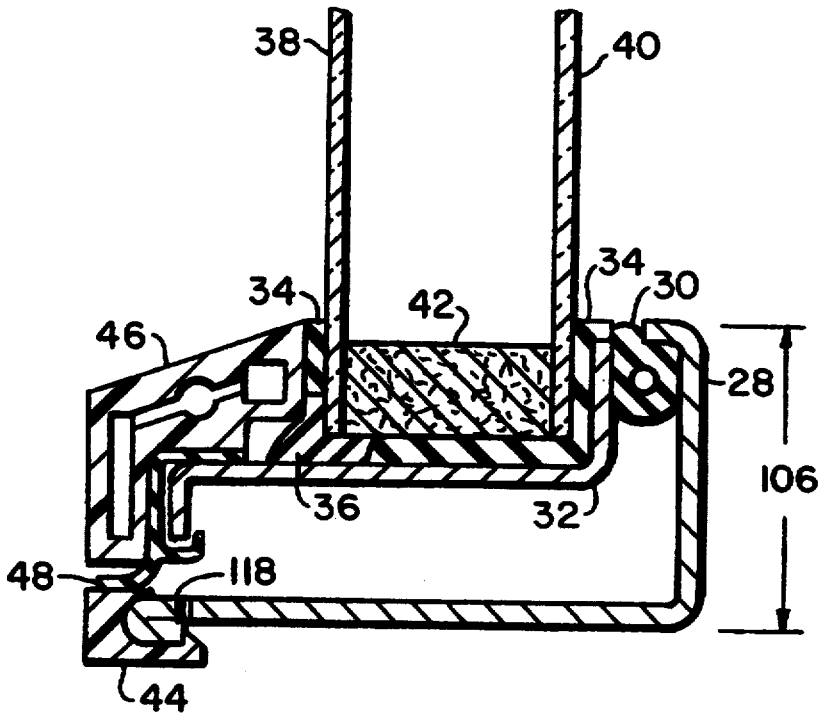
FIG. 2 is a section view as taken along line 2—2 of FIG. 1.
Figure 3:
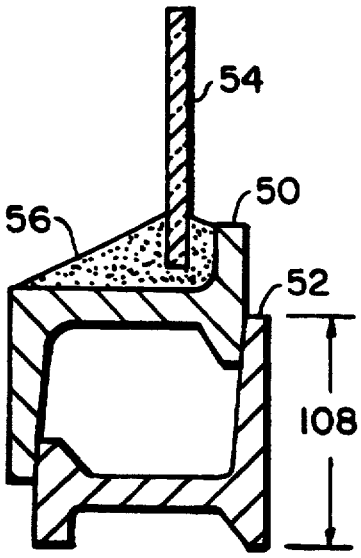
FIG. 3 is a section view of an old steel window structure for comparison with FIG. 2.
Figure 4:
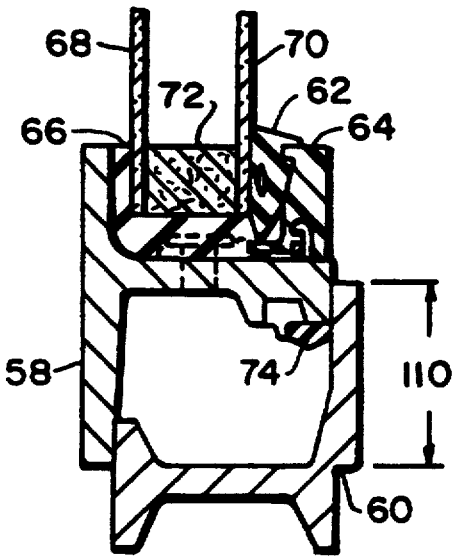
FIG. 4 is a section view of a current steel window structure for comparison with FIG. 2.
Figure 5:
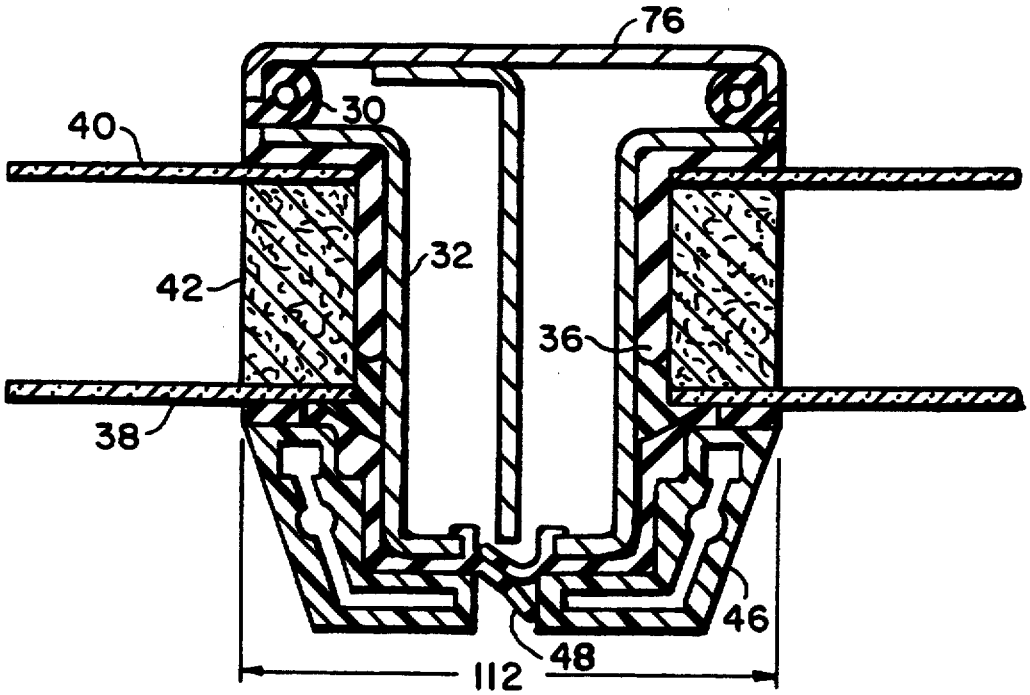
FIG. 5 is a section view as taken along line 5—5 of FIG. 1.
Figure 6:
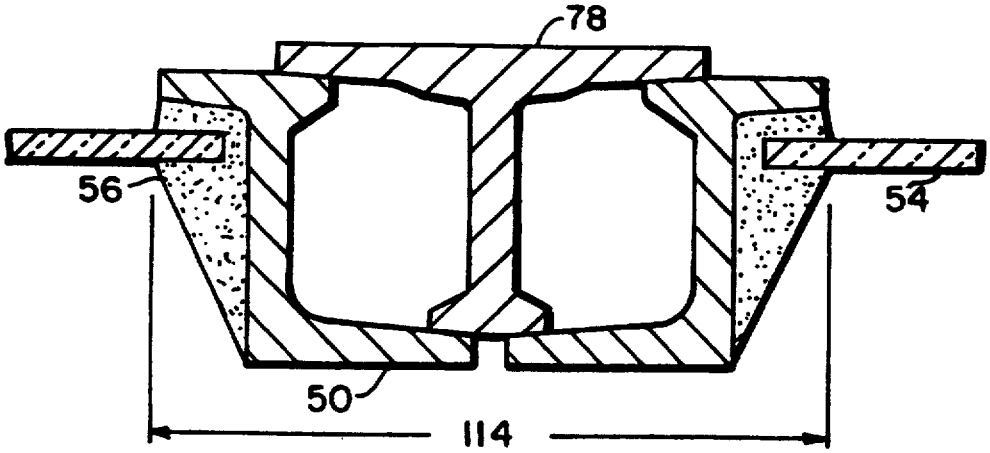
FIG. 6 is a section view of an old steel window structure for comparison with FIG. 5.
Figure 7:
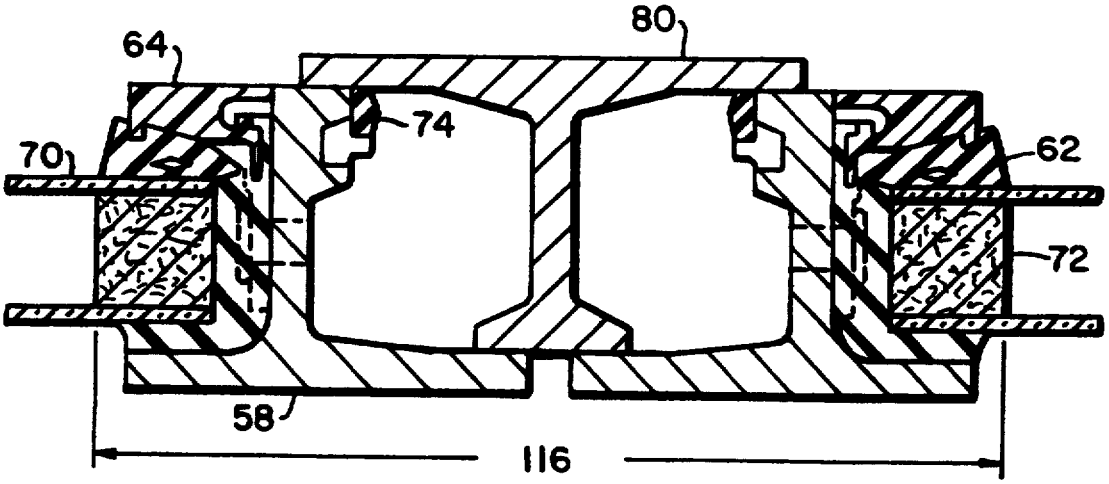
FIG. 7 is a section view of a current steel window structure for comparison with FIG. 5.
Figure 8:
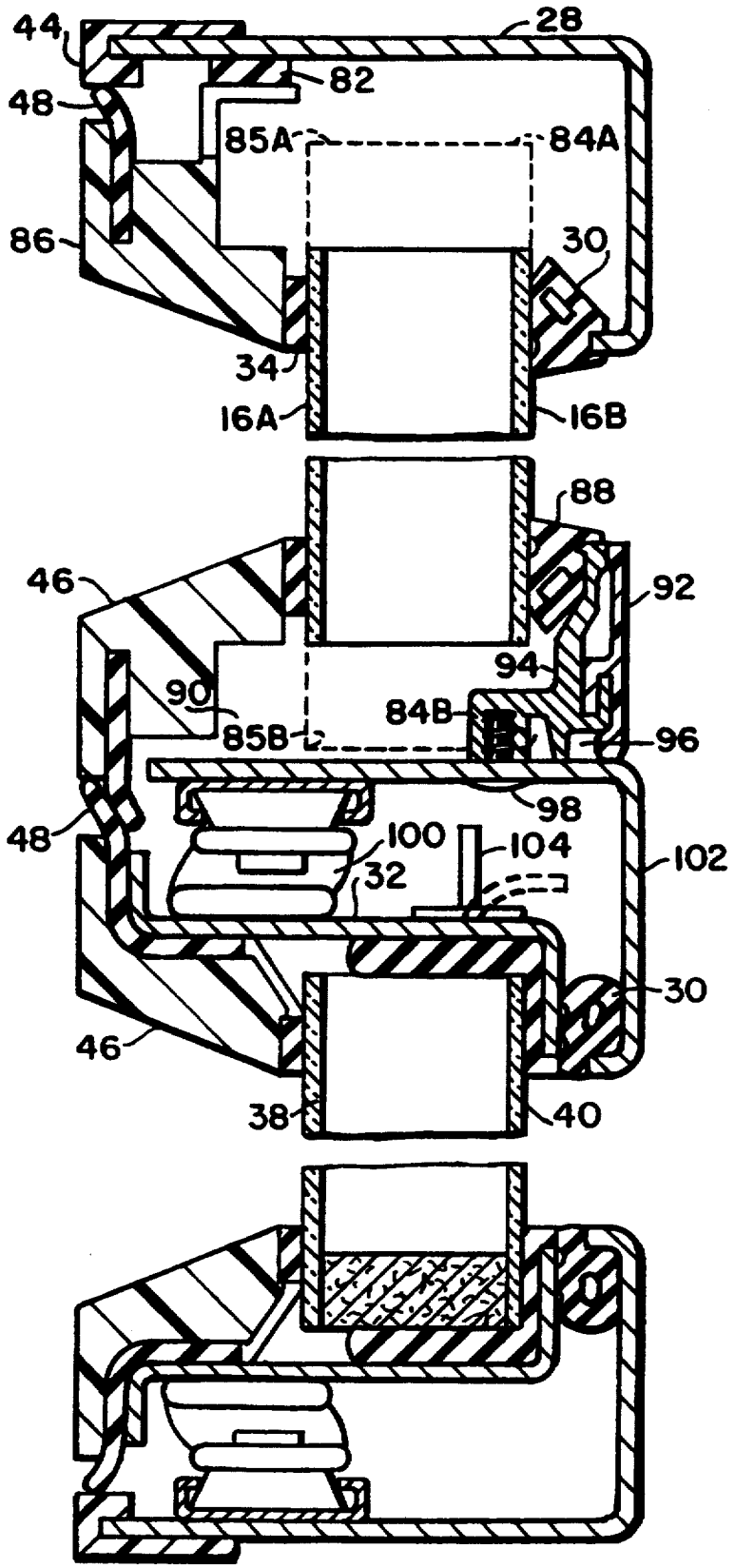
FIG. 8 is a section view taken along the line 8—8 of FIG. 1.

In FIGS. 2, 5, and 8 similar structures having similar functions are denoted with the same numerals, and in FIGS. 3, 4, 6, and 7 similar structures having similar functions are denoted with the same numerals.

As shown in FIG. 2 the perimeter frame has an L shaped perimeter frame bar 28, with an exterior main frame trim molding 44 affixed to it. The perimeter frame bar is of simplified design, having a frame portion and a flange portion, and while it can be made in hot rolled steel, for the purposes of the invention it is fabricated in cold roll steel, typically 12 gauge steel. An operable vent bar 32 is supported on a $\frac{5}{8}$" stack four bar hinge 100 which is well known to the art. Types of hinges typically employed in operable vents such as depicted in FIG. 2 include pivot hinges and the illustrated four bar hinges. It is important to note that throughout this invention provisions for accommodating standard, readily available hardware for window fabrication is incorporated in the structure of the invention. The four bar hinge 100 is affixed between the L shaped perimeter frame bar and an operable frame bar by suitable screws (not shown). A typical dimension (106) of 1.25" is given for the width of the perimeter fame bar 28 and the operable frame bar 32 for illustrative comparison with past and current window construction to be further discussed. Similar to the perimeter frame bar the operable frame bar has a frame portion and a flange portion, and is also fabricated in cold roll steel in the same gauge. A prime interior weather strip 30 separates the perimeter and operable frame bars. This weather strip can be made out of a variety of suitable elastomeric materials.

In FIG. 2 a ventilator exterior cap molding 46 is shown affixed to the exterior end of the operable frame bar 32 flange portion. Both the exterior mainframe trim molding 44 and the ventilator exterior cap molding are normally fabricated in the same color and material, which can be any color and any suitable material. The purpose of these trims and caps is to simulate the monolithic glazing methods present in the aesthetically desirable older buildings, and also to assist in providing a complete thermal break between steel sections of the frame that would otherwise be exposed to exterior atmosphere. Between the trim, ventilator cap, perimeter frame bar and operable vent bar is an exterior rain screen weather strip 48 which can be fabricated in a variety of suitable elastomers. A weep hole 118 near the external edge of the perimeter frame bar extends through trim 44 to assist in pressure equalization in the cavity between the flange portion of the operable vent bar and the flange portion of the perimeter frame bar, and in the draining of any water that may gain entrance away from this cavity and to the exterior of the frame. A pane of 1" insulating glass 26 is inserted between the ventilator cap and within the flange portion of the operable vent bar, with the exterior pane 38 secured to the operable vent bar by a poured in place silicone rubber (RTV) 36, and to the ventilator exterior cap 46 with an elastomeric spacer 34. Similarly the interior glass pane 40 is separated from the frame portion of the operable vent bar by the elastomeric spacer 34. A spacer 42 between the exterior 38 and interior 40 panes contains a desiccant for residual moisture removal.

FIG. 3 is a similar view to FIG. 2 of the structure of FIG. 2 as it might look like in the original, aesthetically desirable older windows. In this case the perimeter main frame 52 is a heavier section of hot rolled steel. A one piece operable vent bar 50 secures the monolithic, single paned, non-insulating glass 54 within a putty slope 56. A comparative dimension (108) of 0.875" is given for comparison with FIG. 2. The structure of FIG. 3 forms the basis for the aesthetic judgement of a virtually "ideal" elegantly narrow window structure. As can be seen, while presenting a desirable appearance these older window structures cannot accommodate modern day demands for double paned, insulating glass.

In FIG. 4 a view similar to FIG. 2 and FIG. 3 is given for a version of current steel window structure. A perimeter main frame 60 is a substantial section of hot rolled steel. A one piece operable vent bar 58 provides the means for securing the insulating glass with an exterior glass pane 68 and an interior glass pane 70. As in FIG. 2 a desiccant spacer 72 separates the two panes of glass. An elastomeric spacer 66 separates the exterior glass pane 68 from the laterally extending wall of the operable vent bar. A continuous elastomeric compression wedge separates the interior pane 70 and a removable glazing bead 64. An interior elastomeric weather strip 74 is provided at the interior juncture of the operable vent bar 58 and the perimeter main frame (which are both fabricated in hot rolled steel). A comparative dimension (110) of 1.0" is given for comparison with the similar structures of FIGS. 2 and 3. Thus it can be seen that current steel window construction, while providing for modern day insulating glass requirements, results in a wider and flatter external appearance, which is less attractive to some architects than the older casement window frames. And, of course, these newer windows cannot be used to replace the old style windows with any hope of maintaining the original appearance.

FIG. 5 shows a full T intermediate framing bar 76 of the instant invention, having a frame portion and a flange portion, utilized between two operable lights. As also shown in FIG. 2 the left hand insulating glass 26 (FIG. 1) is mounted within the frame portion of an operable vent bar 32 and a ventilator exterior cap 46, being firmly secured to the operable vent bar by means of poured in place silicone rubber 36. An exterior rain screen 48 is placed between the reveal separating the left and right exterior caps, and a primary interior operable weather strip forms a secure air/water seal at the smooth, cold rolled seal surfaces of the frame portion of the full T intermediate framing bar and the frame portion of the operable vent bars. The full T intermediate framing bar 76 is also referred to as a double meeting rail, and is found between two operable lights. A comparative dimension (112) of 2½" is given for a typical comparison of the sight line between operable vents of the instant invention, the desirable old style shown in FIG. 6, and the current wider and flatter appearance of FIG. 7.

FIG. 6 is a similar view to FIG. 5, illustrating the structure of the old style steel windows. A substantial section of hot rolled steel forms a full T intermediate framing bar 78. One piece operable vent bars 50 also fabricated in hot rolled steel secure left and right hand panes of monolithic, non-insulating glass 54 secured to the operable vent bars by a putty slope 56. A comparative typical dimension (114) of 2½" is given for this sight line between operable vents in this old style steel window construction.

FIG. 7 illustrates a current steel window construction version of the structures of FIGS. 5 and 6. Again a full T intermediate framing bar 80 is shown, fabricated in a substantial section of hot rolled steel. One piece operable vent bars 58 provide the means for securing both the external panes of glass 68 and the internal panes of glass 70 forming the modern day insulating glass window. Continuous elastomeric seal compression wedges 62 and glazing beads 64 provide the means for internally glazing the insulating glass. A typical comparative dimension (116) of 4.0" is given to illustrate the necessarily very different sight lines between operable vents that is obtainable with current versions of steel window construction.

In FIG. 8 the concept of how the instant invention deals with mounting fixed lights in combination with operable lights is shown. An L shaped perimeter frame bar 28 is shown at the top left hand corner of the window structure (FIG. 1). The exterior edge of the flange portion of the perimeter frame bar is covered with exterior main frame trim molding 44 which is normally fabricated in a plastic material so as to provide a thermal break (insulation) for the cold rolled steel perimeter frame bar. Externally affixed to both the perimeter frame bar 28 by means of elastomeric thermal break spacer 82 and to the exterior face 16A of the insulating glass by means of an elastomeric spacer 34 is mitered corner fixed light exterior cap molding 86. This fixed light exterior cap is normally made out of the same material and is the same color as similar components (e.g. ventilator exterior cap 46) in the operable lights. A prime interior operable weather strip 30 separates the interior pane 16B of the insulating glass and the downwardly extending frame portion of the perimeter frame bar. The base portion of the insulating glass 16 (FIG. 1) is supported by a semi T framing bar 102. Semi T framing bars have a frame portion and a flange portion, and are utilized between fixed and operable lights. The base portion of the insulating glass 16 is secured to the semi T framing bar 102 by means of an exterior cap 46 affixed to the external edge of the flange portion of the semi T framing bar and to the exterior face 16A of the bottom portion of the double paned insulating glass. The interior face 16B of the bottom portion of the insulating glass is secured by a glazing bead 94 anchored to the semi T bar 102 by means of a wet caulking 96, with a continuous elastomeric compression wedge 88 therebetween. A glazing bead fastener 98 secures the glazing bead to the semi T bar. Finally, a cosmetic cover 92 is secured to the glazing bead to hide the continuous and end glazing bead wet seal caulking. Immediately below the fixed light 16 the left hand operable light 26 is secured to the underside of the semi T bar 102 by means of a ventilator exterior cap 46 affixed to both an operable vent bar and the exterior face 38 of the insulating glass 26, with the interior face 40 of the insulating glass 26 being secured by the downwardly extending frame portion of the operable vent bar 32 and the downwardly extending frame portion of the semi T bar 102, with a prime interior operable weather strip 30 therebetween. Affixed between the semi T bar and the operable vent bar a four bar hinge 100 provides the means for opening and closing the insulating glass 26 securing window structure. Secured to the upper surface of the operable vent bar 32 is a rubber dam 104 the function of which is to prevent water that may get by the rain screen 48 from reaching the weather strip 30, and thereafter possibly gaining entrance to the interior of the building.

FIG. 8 illustrates the important concept of "Tuck" or "Jiggle" glazing as it applies to the instant invention. Dotted lines 84A and 85A illustrate the top edge of an engagement area which extends the left hand vertical length (FIG. 1) of the fixed vent perimeter frame. Similarly the dotted lines 84B and 85B illustrate the bottom edge of an engagement area which extends the horizontal length of the upper surface of the semi T bar portion of the fixed light frame. Immediately below the area designated by dotted lines 84B and 85B is an area 90 illustrated in phantom, which is the edge space tolerance necessary for the functioning of Tuck glazing. Tuck glazing requires a removable glazing bead with edge engagement height times 2 plus necessary edge tolerance, plus an adjacent frame glazing pocket with the same edge engagement height times 2 plus necessary edge space tolerance. The above described removable glazing bead 94 and adjacent edge engagement and edge space tolerance areas provide the necessary means for internal glazing of fixed lights, such as fixed light 16 in the instant invention.

The advantages of the steel window structure of the invention over current steel window structures are as follows:

1. Utilizing the structure of the invention you have perimeter mainframe bars conjoined with intermediate framing bars of either the full or semi T configuration awaiting insertion of operable ventilator components and/or fixed light components, so that they all appear with a uniform profile when viewed from the exterior.

For example, the structure of the invention provides a glass to glass sight line as low as $1\frac{3}{4}''$. Sight lines of 2" to $2\frac{1}{2}''$ are easily obtained in a routine and practical manner.

2. The steel window structure of the invention inherently provides for a complete thermal break between the internal and external framing members. In contrast to current steel window construction which makes use of monolithic, hot rolled steel sections (FIGS. 4, 7), the invention inherently has no metal to metal contact between the interior and exterior portions of the structure. This is important even though steel has only $\frac{1}{3}$ the conducting capacity of aluminum. In current fabrication techniques exterior and interior steel structures are directly connected, providing a significant heat transfer path either from the outside of the building to the interior or vice versa.

3. It is highly desirable from the point of view of quality and economy to have the exterior and interior steel members of a steel window structure to have a factory painted finish. Typically paint is used that is ultra-violet resistant, and having a shiny finish for long term good appearance and water protective functioning. From a practical point of view one color is used, so that both the interior and exterior steel sections are the same color.

In the present invention there is no direct connection between the interior and exterior steel sections. Since the interior sections are not going to be exposed to the outdoor atmosphere they can be an entirely different color and finish from the exterior sections. Again this permits the same attractive finishes common to the old style windows which routinely had separately painted exterior and interior sections.

4. Another advantage inherent to the present invention is superior air and water resistance. In current steel window construction the hot rolled steel members have a rough surface, even after finishing, as compared with the typically smooth cold rolled steel surfaces of the invention. These rough surfaces provide a significant air and water pathway. Utilizing the simpler structures of the invention permits the use of cold roll steel members, and therefore more reliable air and water seals. For example, in FIG. 5 the prime interior operable weather strip 30 is contacting two smooth cold rolled steel surfaces for an unusually reliable weather seal. And even in the case of a fixed light (FIG. 8) the wet seal caulking 98 bonds to a cold rolled steel surface and to the smooth surface of an aluminum (or plastic) glazing bead 94, providing an extremely reliable weather seal.

These reliable seals make possible the full utilization of the pressure equalization principal normally used only on aluminum or plastic window structures. For example, as shown in FIG. 2 air pressure will tend to equalize between the outside air pressure and the pressure within the area bounded by the operable vent bar 32 and the L shaped perimeter frame bar 28, permitting accumulated water to drain harmlessly away through weep holes 118. This is important since outside wind velocity causes significant static pressure to develop within the frame. Typically current steel window structure is rated for 6 to 8 pounds of static pressure differential. The instant invention provides at least 10 pounds of static pressure differential, and can be economically upgraded to accommodate 12 to 16 pounds per square foot static pressure differential.

5. The new steel structure permits one inch thick insulating glass to lie below the edge of both the ventilator and the perimeter frame. This now permits using this structure to replace old style steel windows. However, by having the glass protrude into the small space thus created by the structure effectively reduces the frame width to the point where it isn't strong enough to handle or to install the fixed lights from the building interior after installation, which is an industry requirement for metal windows. To answer this a structure for "Tuck" or "Jiggle" glazing heretofore not used for metal windows was incorporated in this new steel window structure. The above described Tuck glazing structure allows the frame to retain its strength during handling and interior glazing of fixed lights at the same time.

The invention has been described as accommodating 1" thick double paned insulating glass known to the art as an insulating glass unit or I.G.U. The invention will accommodate a wide range of glass panes, including single panes of glass such as bullet proof glass, and is, of course, primarily structured to accommodate the commonly available double panes of insulating glass in the range between ⅝" and 1". Thus is can be seen that the steel window of the invention not only simulates the narrow, elegant appearance of old style steel windows, but surprisingly inherently produces a significantly structurally superior steel window.

While the present invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A steel window structure for placement within a masonry opening, said window structure simulating a narrow masonry-to-glass and glass-to-glass sight lines) prevailing in older steel window structures which secured monolithic non-insulating panes of glass;

said steel window structure having means for securing a glass means having at least one pane of glass, said glass means having a thickness in the range between ⅝" and 1";

said steel window structure having a perimeter mainframe, conjoined .within said perimeter mainframe are at least one semi T mainframe bar for securing at least one fixed light-glass means and at least one full T mainframe bar for securing at least two operable light glass means;

said perimeter mainframe having a first frame portion and a second flange-portion, said semi T mainframe bar having a first frame portion and a second flange portion, said semi T mainframe bar and said perimeter mainframe forming a box like structure for securing said fixed light glass means within the perimeter mainframe and said semi T mainframe bar;

said full T mainframe bar having a first frame portion and a second flange portion, said full T mainframe bar having a left side and a right side, means for securing a first operable light glass means within said left side of said full T mainframe bar within a second box like structure formed by said left side of said full T mainframe bar and said semi T mainframe bar and said perimeter mainframe, means for securing a second operable light glass means within said right side of said full T mainframe bar within a third box like structure formed by said right side of said full T mainframe bar and said semi T mainframe bar and said perimeter mainframe;

said means for securing said operable light glass means including an operable vent bar for each operable light glass means, said operable vent bar having a first frame portion and a second flange portion, said operable vent bar being connected to a hinge structure mounted in an area between said perimeter mainframe and said operable vent bar and/or said semi T mainframe bar and said operable vent bar;

said fixed light glass means and said first and second operable light glass means,including exterior moldings connected to the exterior portion of said glass means, and the exterior portion of said second flange portion of said perimeter mainframe, said second flange portion of said semi T mainframe bar, and said second flange portion of said operable vent bar, said moldings simulating a putty slope configuration of said older steel window structures, so that when viewed from the exterior said sight line between said masonry and said fixed light glass means, and the sight lines between said fixed light glass means and said operable light glass means appears as a uniform profile, the sight line distance between the glass means-to-glass means sight line being between a minimum of 1¾" and a maximum of 4".

2. A window structure according to claim 1 wherein said glass means is double paned insulating glass.

3. A window structure according to claim 1 wherein said perimeter mainframe, said semi T mainframe bar, said full T mainframe bar, and said operable vent bar are fabricated in cold roll steel.

4. A window structure according to claim 1 having means for providing a thermal break for said steel window structures exposed to the interior of said masonry wall and to the exterior of said masonry wall.

5. A window structure according to claim 4 wherein said means for said thermal break includes means for the economical factory application of different finishes to steel portions of said window structure exposed to said interior of said masonry wall, and to steel portions of said window structure exposed to said exterior of said masonry wall.

6. A window structure according to claim 1 wherein said means for securing said fixed light glass means includes a removable glazing bead affixed along the length of the upper surface of said semi T mainframe bar, said box like structure formed by said perimeter mainframe and said semi T mainframe bar having an edge engagement space and an edge tolerance space along said upper surface of said semi T mainframe bar and duplicate engagement and tolerance spaces along an adjacent side of said box like structure, so that when said molding is in place on said exterior of said flange portions of said steel window structure said fixed light glass means can be secured within said box like structure and glazed from within said masonry wall.

7. The window structure according to claim 6 further comprising a wet caulking seal between said removable glazing bead and said upper surface of said semi T mainframe bar, an elastomeric compression wedge between said fixed light glass means and said glazing bead on said semi T mainframe bar, said compression wedge continuing along the surface of said fixed light glass means between the frame portion of said perimeter mainframe so that said compression wedge forms a seal along the edge of said box like structure and said fixed light glass means exposed to the interior of said masonry wall, and a prime interior operable weather strip being placed between the frame portion of the perimeter mainframe, the semi T mainframe bar and the full T mainframe bar, and the frame portion of said operable vent bar, forming a seal along the edge of said operable light steel window structure exposed to the interior of said masonry wall.

8. The window structure according to claim 7 wherein said combination of said interior weather strip, said compression wedge, and said wet caulking provide a minimum 10 pound per square foot static pressure tolerance for said steel window structure.

9. The window structure according to claim 8 wherein said structure provides for effective pressure equalization and therefore effective water drainage from said area between said perimeter mainframe and said operable vent bar.

10. The window structure according to claim 7 further comprising a silicone rubber bond between the exterior surface of slid operable light glass means and said operable vent bar.

11. The window structure according to claim 10 wherein said combination of said silicone rubber bond, said operable light glass means and said operable vent bar provides a monolithic operable ventilator with a permissible width of approximately 40".

* * * * *